US006793284B1

(12) United States Patent
Johnson et al.

(10) Patent No.: US 6,793,284 B1
(45) Date of Patent: Sep. 21, 2004

(54) STEEL SPRING WITH DWELL FOR CHAIRS

(75) Inventors: LeRoy Johnson, Lowell, MI (US); Kevin McMains, Holland, MI (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/391,679

(22) Filed: Mar. 19, 2003

(51) Int. Cl.[7] ..... A47C 7/60
(52) U.S. Cl. ..... 297/302.3; 297/292
(58) Field of Search ..... 297/303.3, 301.3, 297/292, 296, 297, 301.1, 301.4, 303.1, 303.4, 300.1, 300.3, 300.4, 302.1, 302.3, 302.4, 408; 267/155, 131

(56) References Cited

U.S. PATENT DOCUMENTS 4,266,760 A * 5/1981 Matsui et al. ..... 5/622
4,438,898 A * 3/1984 Knoblauch et al. ..... 248/561
4,586,748 A * 5/1986 Dingler et al. ..... 297/300.4
4,600,240 A * 7/1986 Suman et al. ..... 297/408
5,029,940 A * 7/1991 Golynsky et al. ..... 297/300.4
5,238,294 A * 8/1993 Ishi et al. ..... 297/300.5
5,368,283 A * 11/1994 Pavlin ..... 267/155
5,397,165 A * 3/1995 Grin et al. ..... 297/300.5
5,464,274 A * 11/1995 Golynsky et al. ..... 297/328
5,765,914 A 6/1998 Britain et al.
5,772,282 A 6/1998 Stumpf et al.
5,782,536 A * 7/1998 Heidmann et al. ..... 297/440.15
5,803,546 A * 9/1998 Yamazaki ..... 297/333
6,582,019 B2 * 6/2003 Insalaco et al. ..... 297/300.4
6,588,845 B2 * 7/2003 Wilkerson et al. ..... 297/300.2
6,644,744 B2 * 11/2003 Seibold ..... 297/335
6,709,056 B2 * 3/2004 Bock ..... 297/300.4
2003/0107251 A1 * 6/2003 Wu ..... 297/300.4

* cited by examiner

*Primary Examiner*—Peter M. Cuomo
*Assistant Examiner*—Stephanie Harris
(74) *Attorney, Agent, or Firm*—Shook, Hardy & Bacon LLP

(57) ABSTRACT

This invention provides a spring assembly for use in a chair tilt control mechanism. The tilt control mechanism is one that can recline and return a backrest for a chair. The spring assembly includes a cylindrical block that has first and second ends and a central bore. A pair of end caps located at each of the first and second ends of the block. Each end cap has a receiving section that can rotate within the central bore of the block. Each end cap also has a hole extending through it that provides a coupling point for the chair backrest. The spring assembly also includes at least one steel coil spring around the block. The spring has one terminal end coupled to the tilt control mechanism and the other end coupled to one of the end caps. The end caps rotate within the block as the chair backrest is reclined or returned. The forced needed to rotate the end caps is a sum of the spring force provided by the spring and the frictional relationship between the block and the end caps.

34 Claims, 5 Drawing Sheets

STEEL SPRING WITH DWELL FOR CHAIRS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention relates generally to chair control mechanisms, and more particularly to a spring assembly for a chair tilt control mechanism.

BACKGROUND OF THE INVENTION

Task chairs or office type chairs have evolved greatly over the years to improve the support provided to chair occupants and to provide chairs that better meet the usage needs of modem chair users. Comfort and promotion of ergonomically healthy sitting are among factors considered by occupants when choosing a chair. The development of backrest tilt control mechanisms has enabled chair occupants to adjust the backrest of a chair to their preferred positioning.

The spring assemblies associated with chair tilt control mechanisms allow occupants to recline the backrest, and also operate to bias the chair to its upright position when the reclining force is relieved. The spring assemblies are an important component in providing comfort to the user. To allow the users to adjust the chair properly, it is desirable to allow adjustments of the force needed to recline the chair and the force with which the chair returns to an upright position.

It is also desirable that more force be necessary in reclining the backrest of the chair than when resisting the biasing force on the backrest that returns it to an upright position. The difference in these forces is termed "dwell." Dwell is important in meeting the needs of most chair users. With the dwell properly balanced, a user can recline the chair to a desired position and maintain that reclined position with very little effort. Ideally, the mechanism is adjustable so that the weight of the user's upper body balances the chair in the reclined position.

Rubber torsion springs have traditionally been used in the spring assemblies of tilt control mechanisms to achieve the desired dwell in the action of the backrest. In use, the rubber springs are mounted to a rod and energy is stored within the rubber springs as the backrest is reclined. But rubber springs have a limited life due to the inherent limitations of the material. For example, the rubber can break after a long period of use, or the spring characteristics can shift as the rubber ages. Additionally, even new rubber springs can vary due to batch differences in the base rubber material. A mechanism is needed that achieves the desired dwell in the action of the backrest, without the disadvantages of rubber springs.

BRIEF SUMMARY OF THE INVENTION

This invention is directed to a steel spring assembly for creating dwell when returning the backrest of a chair to an upright position from a reclined position.

In one embodiment, the invention provides a spring assembly for use in a chair tilt control mechanism. The tilt control mechanism is one that can recline and return a backrest for a chair. The spring assembly includes a cylindrical block that has first and second ends and a central bore.

A pair of end caps is located at each of the first and second ends of the block. Each end cap has a receiving section that can rotate within the central bore of the block. Each end cap also has a hole extending through it that provides a coupling point for the chair backrest. The spring assembly also includes at least one steel coil spring around the block. Each spring has one terminal end coupled to the tilt control mechanism and the other end coupled to one of the end caps. The end caps rotate within the block as the chair backrest is reclined or returned. The force needed to rotate the end caps is a sum of the spring force provided by the spring and the frictional relationship between the block and the end caps.

In another embodiment the spring assembly further includes a bearing located within the central bore that can rotate within the central bore of the block. Each end cap has a truncated receiving section that can rotate within the central bore of the block. The bearing and end caps rotate within the block as the chair backrest is reclined or returned.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

This invention provides a spring assembly for a tilt control mechanism used on chairs. The spring assembly allows an occupant to exert a force on the backrest of the chair to recline the backrest. The spring assembly also biases the chair to an upright position when the reclining force is relieved. As described below, the spring assembly also provides dwell in the action of the backrest without resort to a rubber torsion spring.

Figure 1:
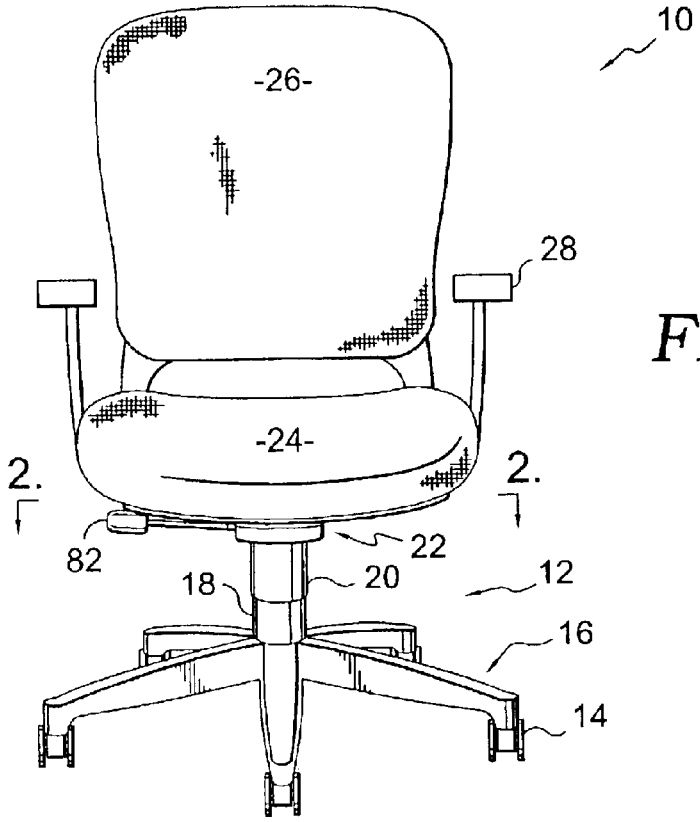
FIG. 1 is a perspective view of a chair.

With initial reference to FIG. 1, a chair on which the mechanism embodying the principles of the invention can be used is generally indicated by reference numeral 10. Chair 10 is equipped with a base assembly 12. Base 12 preferably has a number of castors 14 operably supported on the outer ends of a corresponding number of support legs 16. Support legs 16 converge to a pedestal column 18. Column 18 supports a gas cylinder 20 that allows the height of the chair to be adjusted by an occupant, as is known to those of skill in the art. The construction of the base 12 and column 18 is well known to those of skill in the chair industry.

With continued reference to FIG. 1, a tilt control mechanism 22 is coupled at one point to gas cylinder 20. Tilt control mechanism 22 is also coupled to a seat 24 and a chair backrest 26. Preferably, a pair of armrests 28 is also coupled to tilt control mechanism 22 or seat 24 or back 26.

Figure 2:
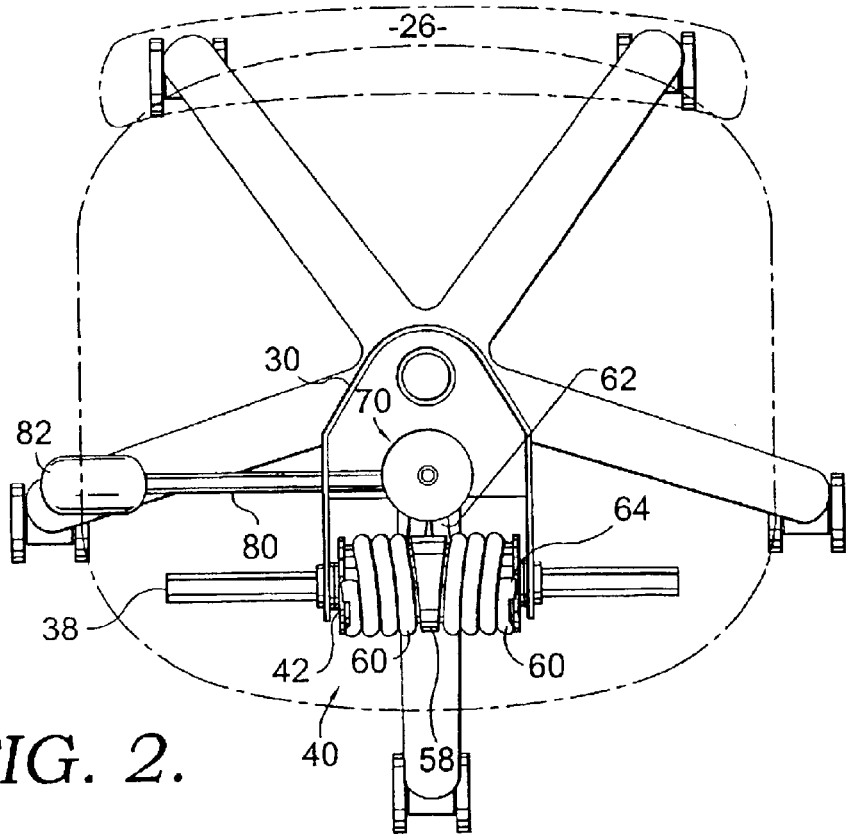
FIG. 2 is a view of a tilt control mechanism taken along line 2—2 of FIG. 1.
Figure 3:
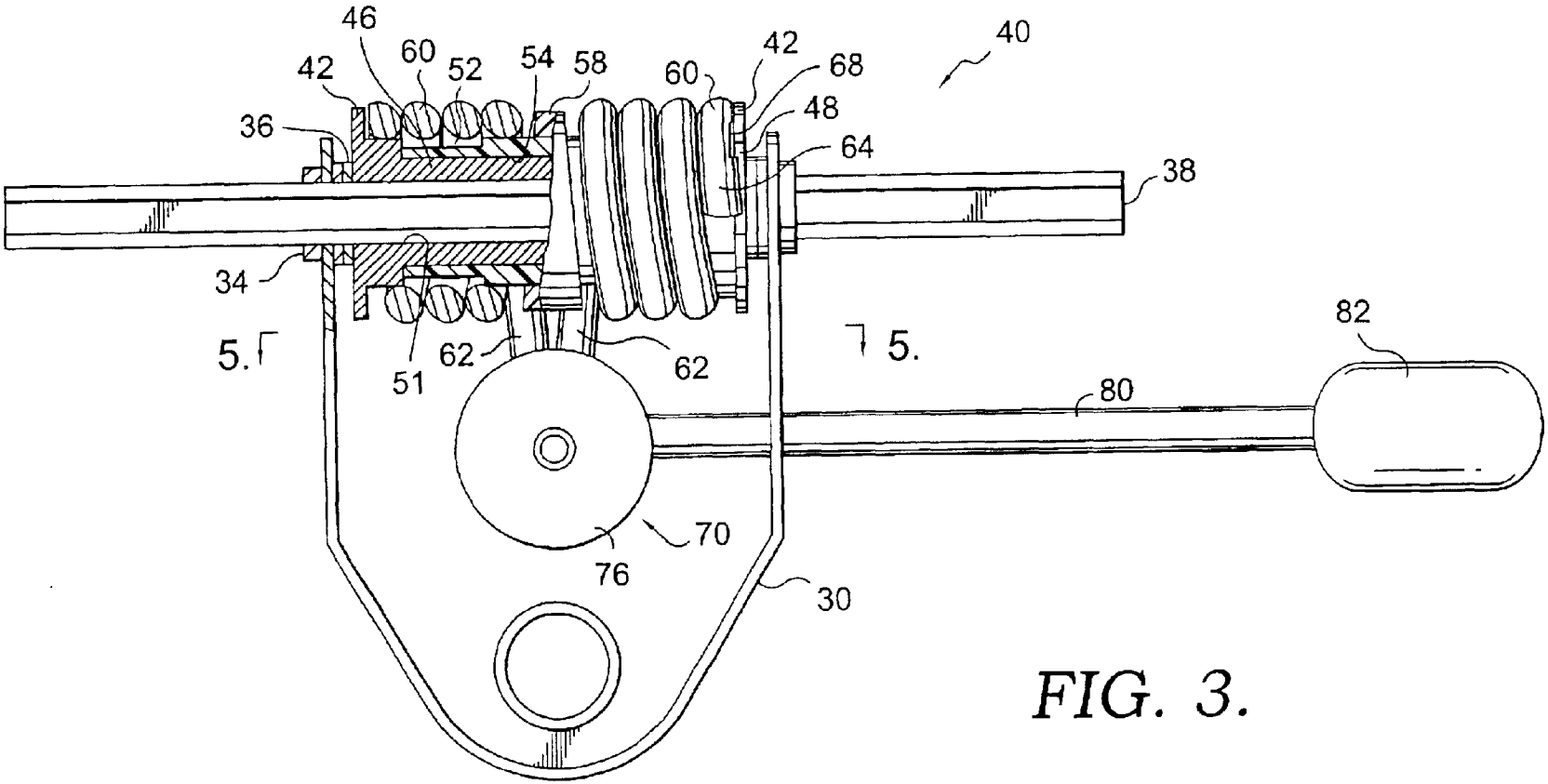
FIG. 3 is a view of the tilt control mechanism similar to FIG. 2 with portions shown in cross-section to reveal details of construction.
Figure 4:
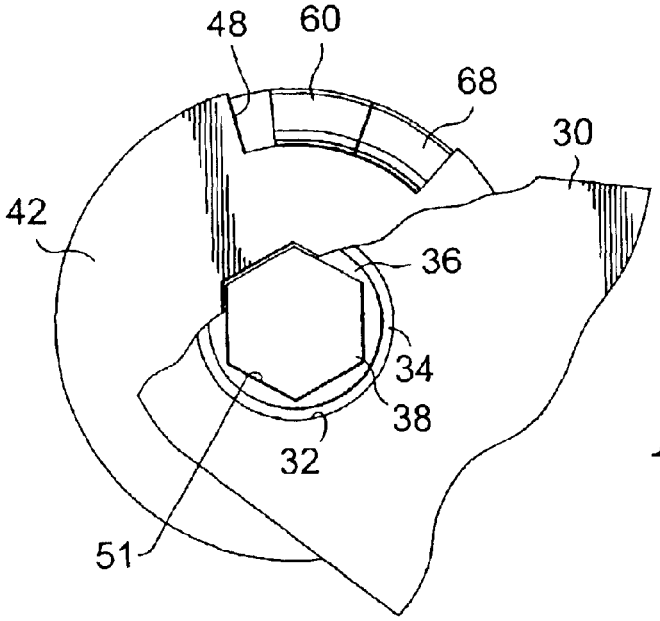
FIG. 4 is a partial side view of the tilt control mechanism with parts broken-away to reveal details of construction.

Having briefly described the basic elements of chair 10, a more detailed description of the various elements of tilt control mechanism 22 is described below. FIGS. 2, 3, and 4 show various components of tilt control mechanism 22. Tilt control mechanism 22 has a base housing or chassis 30. Chassis 30 is preferably a stamped metal piece that provides the overall structure for holding the various components of the mechanism as described below. Chassis 30 has a pair of spaced-apart sides, each of which has a hole 32. Hole 32 is used to hold a bearing 34 in place, such as by a press-fit relationship. Bearing 34 is preferably steel and has a hole as well. A bushing 36 is located within the hole of bearing 34, as best seen in FIG. 4. The bushing 36 has a polygonal hole formed therein, the importance of which is described below. As seen in the figures, the hole is preferably a hexagonal hole. Bushing 36 has an outer diameter that closely matches the diameter of the hole in the bearing 34, such that the bushing 36 can rotate relative to the bearing 34. In a preferred embodiment, bushing 36 is made from a plastic material. The mechanism 22 also includes an elongated rod 38 that is held within the bushings 36. More specifically, the shape of rod 38 matches the shape of the hole through the bushings 36. In the preferred embodiment, the shape of rod 38 and the shape of the hole of bushing 36 are hexagonal. Rotation of the rod 38 rotates the bushings 36 within the bearings 34.

Rod 38 is used to hold and operate a spring assembly 40 and to attach tilt control mechanism 22 to the frame of chair 10. As would be understood by those of skill in the art, only the basic components of the tilt control mechanism 22 that relate to the spring assembly 40 are shown in the figures. Other components, such as a height adjustment mechanism or a tilt lockout mechanism could be incorporated into mechanism 22, as would be understood by those of skill in the art. Returning to the spring assembly 40, FIG. 6 most clearly shows the construction, which includes an end cap 42 on each end of the assembly 40. End caps 42 are preferably made of a metal material, including steel, a sintered metal, a cast metal, or another material of comparable strength. Each end cap 42 has a cap section 44 that extends radially beyond a receiving section 46 that extends axially inward from cap section 44. Each end cap 42 also has a spring fulcrum section 47. As best seen in FIG. 4, cap section 44 has a notch 48 formed in a part thereof, the importance of which is described more-fully below. A polygonal hole 51 extends through both cap section 44 and receiving section 46. Hole 51 is shaped to match the shape of rod 38. In the preferred embodiment the hole 51 is hexagonal.

The spring assembly 40 also includes a block 52. Block 52 has a hole 54 that extends axially through the entire length of the block 52. The hole 54 is used to hold the block 52 on the receiving section 46 of the end caps. Each receiving section 46 extends into the hole 54. The hole 54 has an inner diameter that closely matches the outer diameter of the receiving section 46. Block 52 also has a pair of raised spring fulcrum sections 56 that are separated by a radially extending spring separator section 58. As best seen in FIG. 2, spring separator section 58 is preferably shaped to separate a pair of coil springs 60.

Figure 7:
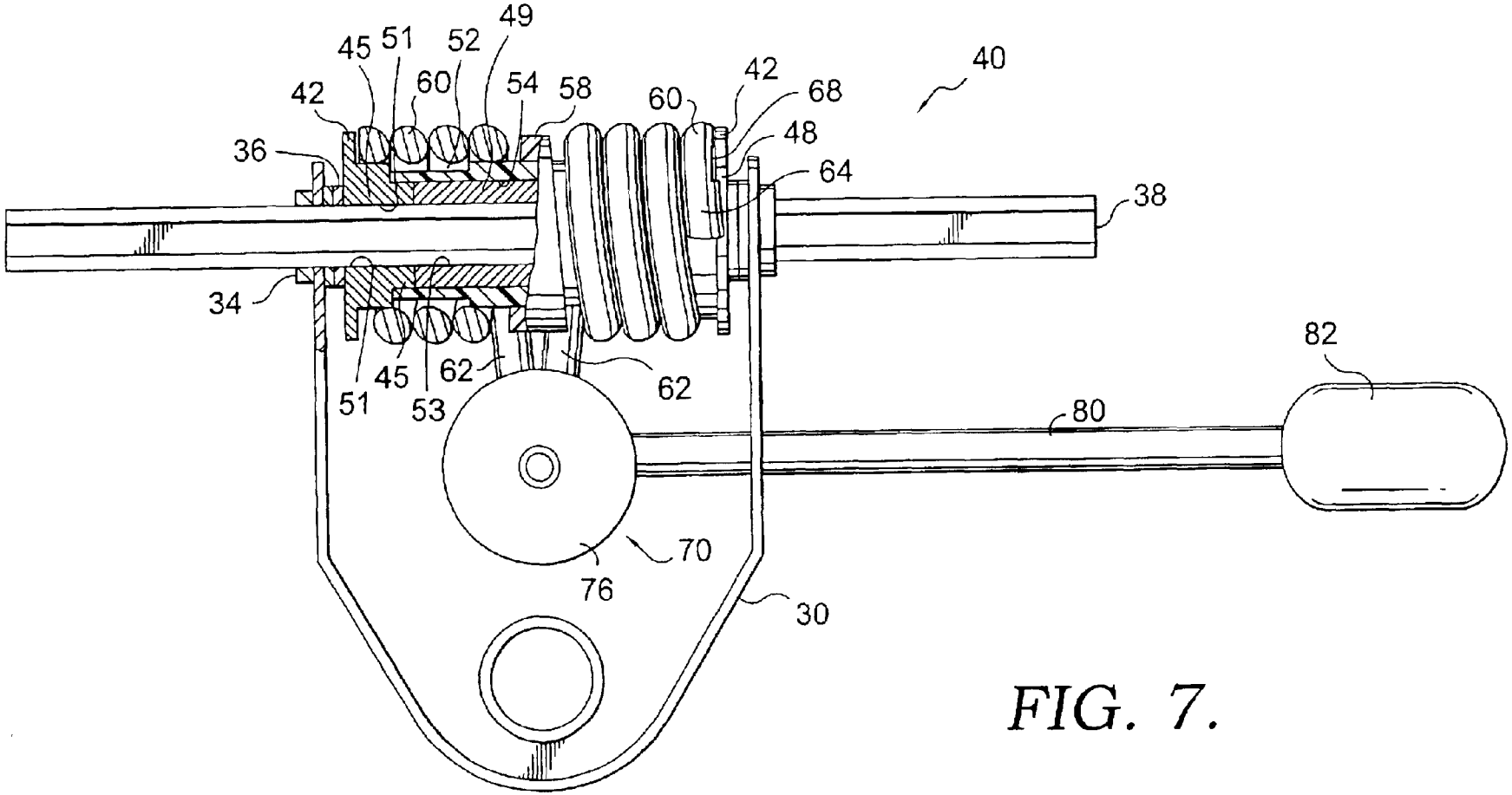
FIG. 7 is a view of another embodiment of the tilt control mechanism, similar to FIG. 3, with portions shown in cross-section to reveal details of construction.

In another embodiment best shown in FIG. 7, the spring assembly 40 further includes a bearing 49 located within hole 54 of block 52. Bearing 49 is able to rotate within hole 54. In this embodiment each end cap 42 has a truncated receiving section 45 that extends into the hole 54. A polygonal hole 51 extends through each end cap 42, including truncated receiving sections 45. Further, a polygonal hole 53 extends through bearing 49. Polygonal holes 51 and 53 are shaped to match the shape of rod 38. In this embodiment, hole 54 is used to hold the block 52 on the bearing 49 and on the truncated receiving sections 45 of the end caps. Hole 54 has an inner diameter that closely matches the outer diameter of the bearing 49. Preferably, bearing 49 is made of a plastic material.

Figure 6:
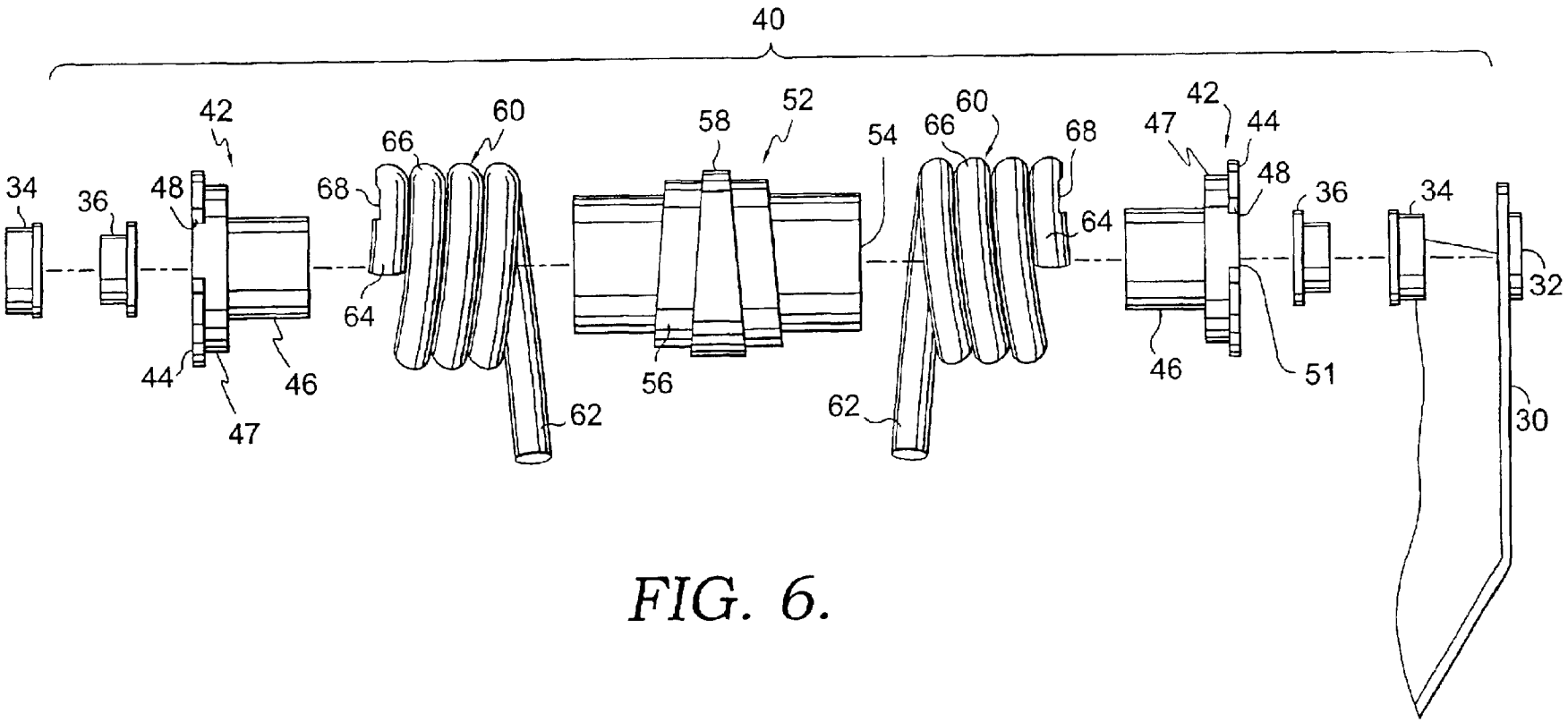
FIG. 6 is an exploded view of the spring assembly components of the tilt control mechanism.

Each coil spring 60 has a longer tail end 62 and a shorter tail end 64. In-between the tail ends 62 and 64 are a number of spring coils 66. The short tail 64 has a notch 68 that is located and shaped to mate with the notch 48 in the end cap 42. As best seen in FIGS. 2 and 6, springs 60 are held in place on block 52 and are separated from one another by spring separator section 58. Longer tail end 62 and shorter tail end 64 pivot upon fulcrum sections 56 and 47, respectively, allowing coil spring 60 to coil with minimum restriction. Preferably, springs 60 are made of steel.

Figure 5:
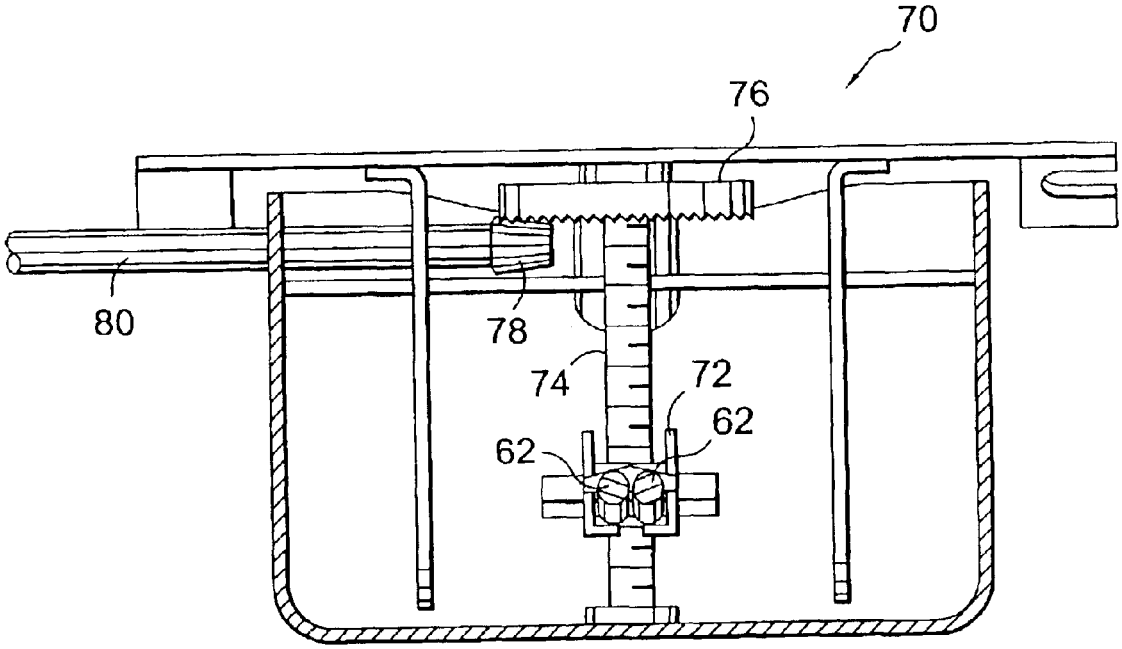
FIG. 5 is a partial cross-section taken along line 5—5 of FIG. 3.

The tension within springs 60 is preferably adjustable with a tension adjustment mechanism 70. As best seen in FIG. 5, the long tails 62 of springs 60 are held within a receiving bracket or nut 72. The receiving bracket or nut 72 is threaded onto a threaded rod 74. Rod 74 terminates at a large bevel gear 76 that mates with a smaller bevel gear 78. The smaller bevel gear 78 is mounted on the end of a rod 80 that terminates at a handle 82. By rotating the handle 82, the user can move the bracket 72 upwardly or downwardly to adjust the initial tension on springs 60. The tension in springs 60 determines the force necessary to recline the backrest 26 of chair 10.

Spring assembly 40 is held in place within tilt control mechanism 22 by rod 38. More specifically, springs 60 are placed over the spring fulcrum sections 56 and 47 of block 52 and end caps 42, respectively. The receiving sections 46 or 45 of the end caps 42 are placed in hole 54 of block 52. Rod 38 then slides through bushing 36, into the hole 51 of end caps 42 and out the other bushing 36. The outwardly extending ends of rod 38 are then coupled to backrest 26. As would be understood by those of skill in the art, many configurations are available for the attachment of the backrest 26 to the rod 38. The attachment is made such that reclining the backrest causes rotation of the rod 38.

As shown in FIG. 3, and as discussed above, receiving sections 46 of end caps 42 are placed within hole 54 of block 52. Preferably, block 52 is made from a material that creates a desired frictional relationship with end caps 42. The desired relationship creates a frictional force such that dwell is achieved in the action of spring assembly 40. Again, one such material that may be used for block 52 is nylon in connection with a metal end cap 42. It will be understood that any materials that create the desired frictional relationship and have properties necessary to maintain the frictional relationship may be chosen for end caps 42 and block 52. One spring 60 is disposed over spring fulcrum sections, 47 and 56, with the notch 68 of short tail 64 located within notch 48 of the end cap 42. The long tail 62 is held within the receiving bracket 72.

In another embodiment as shown in FIG. 7, and as discussed above, truncated receiving sections 45 and bearing 49 are placed within hole 54 of block 52. It is preferable that block 52 is made from a material that creates a desired frictional relationship with bearing 49. In another embodiment it is preferable that block 52 is made from a material that creates a desired frictional relationship with end caps 42 and bearing 49.

In operation, a user can adjust the energy in springs 60, which adjusts the force required to recline backrest 26. The restoring torque exerted by springs 60 against the rotation of rod 38 can be adjusted by changing the position of the long tails 62. Rotation of the handle 82 causes the receiving bracket 72 to move linearly along the axis of the rod 74, which in turn moves tails 62 to the desired radial location. Preferably, the gear ratio of the bevel gears 76, 78 is such that a minimal amount of effort is required to adjust springs 60 to vary the initial restoring torque of the springs and, thereby, control the rate at which backrest 26 tilts rearwardly and returns to an upright position.

When the user reclines, rod 38 rotates. This rotation causes bushing 36 to rotate within bearing 34 and causes end caps 42 to rotate relative to block 52. The friction between the end caps 42 and the block 52 adds to the reclining force, such that the force required to recline the backrest is greater than the return force of the backrest. In another embodiment the rotation of rod 38 further causes bearing 49 to rotate relative to block 52. In this embodiment the friction between bearing 49 and block 52 adds to the reclining force. In another embodiment the friction between both bearing 49 and end caps 42 with block 52 adds to the reclining force. The steel spring assembly 40 can achieve roughly the same reclining force and dwell action as the traditional rubber torsion springs. The springs 60 are more durable than the rubber springs, and offer a more consistent spring assembly.

The action of backrest 26 may be adjusted by altering the materials and dimensions of the components of spring assembly 40. As suggested above, different materials may be used for end caps 42 and block 52 to adjust the frictional relationship between these two components. The desired frictional relationship between end caps 42 and block 52 may also be altered by adjusting the dimensions of these elements. For example, the diameter of receiving section 46 can be altered to provide more or less clearance from block 52. In addition, the outer diameter of receiving section 46 (FIG. 3), or the outer diameter of truncated receiving section 45 and bearing 49 (FIG. 7), along with the inner diameter of hole 54 of block 52 may be altered to adjust the amount of force necessary to recline the chair. Springs 60 may also be adjusted to vary their resistance. The dimensions of springs 60 and the number of coils 66 may be altered as desired. Such adjustments are also applicable to the embodiment including bearing 49.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A spring assembly for use in a chair tilt control mechanism used to recline and return a backrest for a chair, the spring assembly comprising:

a cylindrical block having first and second ends and a central bore;

a pair of end caps, one end cap located at each of the first and second ends of the block, each end cap having a receiving section rotatingly disposed within the central bore, each end cap having a hole extending therethrough, the hole providing a coupling point for the chair backrest; and a steel coil spring disposed around the block and having terminal ends, one of the terminal ends being adapted to be coupled to the tilt control mechanism and the other of the ends being coupled to one of the end caps, wherein the end caps rotate within the block as the chair backrest is reclined or returned, and wherein the force needed to rotate the end caps is a sum of the spring force provided by the spring and the frictional relationship between the block and the end caps.

2. The spring assembly of claim 1, wherein the block is made of a nylon material.

3. The spring assembly of claim 1, wherein the hole in the end caps is polygonally-shaped.

4. The spring assembly of claim 2, wherein the end caps are made of a metal material.

5. The spring assembly of claim 1, further comprising an inner bearing located within the central bore of the block, and having a hole extending therethrough.

6. The spring assembly of claim 5, wherein the inner bearing is made of an acetyl material.

7. The spring assembly of claim 1, wherein a pair of the springs are provided, and wherein each spring has a pair of terminal ends, one of the terminal ends of each spring being adapted to be coupled to the tilt control mechanism and the other of the ends of each spring being coupled to one of the end caps.

8. The spring assembly of claim 7, further comprising a spring separator section fixedly coupled to the block and extending radially outwardly therefrom and between the two steel springs, wherein the spring separator section is adapted to control the positioning of the springs.

9. The spring assembly of claim 8, further comprising a polygonally-shaped rod disposed through the end caps, the polygonally-shaped rod providing the coupling point for the backrest.

10. The spring assembly of claim 7, wherein the end caps each have a retaining end that extends outwardly from the receiving section adjacent the end of the respective first and second ends of the block, and wherein the retaining ends each have a notch therein for receipt of one of the ends of the springs, the notches operating to rotate the ends of the springs as the end caps rotate.

11. A backrest tilt control mechanism for a chair having a base, a seat and a reclining backrest, the mechanism comprising:

a housing adapted to be coupled to the base;

an elongated rod extending through the housing and rotatingly held therewithin, the rod adapted to be coupled to the backrest;

a pair of spaced apart end caps coupled within the housing and coupled to the rod, the end caps rotating as the rod rotates, the end caps each having a cap section and a receiving section;

a cylindrical block having first and second ends and a central bore, the receiving sections of the end caps extending into the central bore, the end caps rotating relative to the block;

a pair of springs disposed over the block, each spring having an inside leg and an outside leg, the inside leg being coupled to the housing and the outside leg being coupled to an adjacent cap section of one of the end caps, wherein the backrest rotates the rod upon recline, and as the rod rotates the end caps rotate within the block, causing energy to be stored in the spring as the end cap rotates the outside leg of the spring and wherein the relative movement of the end caps to the block creates a desired frictional resistance.

12. The mechanism of claim 11, wherein the end caps are made of a metal material.

13. The mechanism of claim 11, further comprising a bearing located within the central bore of the block, the bearing rotating within the block as the rod rotates.

14. The mechanism of claim 13, wherein the bearing is made of an acetyl material.

15. The mechanism of claim 11, wherein the springs are made of steel.

16. The mechanism of claim 15, further comprising an adjustment member coupled within the housing, wherein the inside legs of the springs are adjustably secured to the adjustment member so that the initial energy stored within the springs is adjustable.

17. The mechanism of claim 16, wherein the block is made of a nylon material.

18. The mechanism of claim 17, further comprising a spring separator section fixedly coupled to the block and between the two steel springs, wherein the spring separator section is adapted to control the positioning of the springs.

19. The mechanism of claim 11, wherein the rod is polygonally-shaped.

20. A chair having a base, a seat coupled to the base and a backrest that reclines relative to the seat, comprising:

a housing coupled to the base;

an elongated rod extending through the housing and rotatingly held therewithin, the rod being coupled to the backrest at its outer ends;

a pair of spaced apart end caps coupled within the housing and coupled to the rod, the end caps rotating as the rod rotates, the end caps each having a cap section and a receiving section;

a cylindrical block having first and second ends and a central bore, the receiving sections of the end caps extending into the central bore, the end caps rotating relative to the block;

a pair of springs disposed over the block, each spring having an inside leg and an outside leg, the inside leg being coupled to the housing and the outside leg being coupled to an adjacent cap section of one of the end caps, wherein the backrest rotates the rod upon recline, and as the rod rotates the end caps rotate within the block, causing energy to be stored in the spring as the end cap rotates the outside leg of the spring and wherein the relative movement of the end caps to the block creates a desired frictional resistance.

21. The mechanism of claim 20, wherein the end caps are made of a metal material.

22. The mechanism of claim 20, further comprising a bearing located within the central bore of the block, the bearing rotating within the block as the rod rotates.

23. The mechanism of claim 22, wherein the bearing is made of an acetyl material.

24. The mechanism of claim 20, wherein the springs are made of steel.

25. The mechanism of claim 24, further comprising an adjustment member coupled within the housing, wherein the inside legs of the springs are adjustably secured to the adjustment member so that the initial energy stored within the springs is adjustable.

26. The mechanism of claim 25, wherein the block is made of a nylon material.

27. The mechanism of claim 26, further comprising a spring separator section fixedly coupled to the block and between the two steel springs, wherein the spring separator section is adapted to control the positioning of the springs.

28. The mechanism of claim 20, wherein the rod is polygonally-shaped.

29. A method of tuning a spring assembly for use in a chair tilt control mechanism used to recline and return a backrest for a chair, the spring assembly comprising a cylindrical block having first and second ends and a central bore; and a pair of end caps, one end cap located at each of the first and second ends of the block, each end cap having a receiving section rotatingly disposed within the central bore, each end cap having a hole extending therethrough, the hole providing a coupling point for the chair backrest; wherein the end caps rotate within the block as the chair backrest is reclined or returned, and wherein the force needed to rotate the end caps is a sum of the spring force provided by the spring and the frictional relationship between the block and the end caps, comprising:

determining the desired frictional relationship between the block and the end caps; and providing the block and the end caps, the block made of a material that achieves the desired frictional relationship in combination with the end cap.

30. The method of claim 29, further comprising adjusting the inner diameter of the central bore and of the outer diameter of the receiving section of the end caps.

31. The method of claim 29, further comprising providing a steel coil spring disposed around the block and having terminal ends, one of the terminal ends being adapted to be coupled to the tilt control mechanism and the other of the ends being coupled to one of then end caps, and adjusting the diameter of the spring's coils.

32. The method of claim 31, further comprising adjusting the number of coils in the spring.

33. The method of claim 29, further comprising providing a bearing, wherein the bearing is made of a material that achieves the desired frictional relationship in combination with the block, and the bearing is located within the central bore of the block and rotates within the block as the chair backrest is reclined or returned.

34. The method of claim 33, further comprising adjusting the outer diameter of the bearing.

* * * * *